US007000607B2

(12) United States Patent
Davidi

(10) Patent No.: US 7,000,607 B2
(45) Date of Patent: Feb. 21, 2006

(54) GEMSTONE AND CORRESPONDING METHOD OF CUTTING

(76) Inventor: Ofer Davidi, 26 Tirza St., Ramat Gan (IL)

( * ) Notice: Subject to any disclaimer, the term of this patent is extended or adjusted under 35 U.S.C. 154(b) by 0 days.

(21) Appl. No.: 10/790,216

(22) Filed: Mar. 2, 2004

(65) Prior Publication Data

US 2005/0005640 A1 Jan. 13, 2005

Related U.S. Application Data

(60) Provisional application No. 60/481,079, filed on Jul. 11, 2003.

(51) Int. Cl.
*B28D 5/00* (2006.01)

(52) U.S. Cl. ..... 125/30.01; 451/21; 63/32

(58) Field of Classification Search ..... 63/32; 125/30.01; 451/41, 389
See application file for complete search history.

(56) References Cited

U.S. PATENT DOCUMENTS

| | | | | | |
|---|---|---|---|---|---|
| 5,190,024 | A | * | 3/1993 | Senanayake | 125/30.01 |
| 5,657,646 | A | * | 8/1997 | Rosenberg | 63/32 |
| 6,363,745 | B1 | * | 4/2002 | Greeff | 63/32 |
| D466,045 | S | * | 11/2002 | Yacoubian | D11/90 |
| D498,698 | S | * | 11/2004 | Davidi | D11/89 |

* cited by examiner

*Primary Examiner*—Jack W. Lavinder
(74) *Attorney, Agent, or Firm*—Mark M. Friedman

(57) ABSTRACT

A gemstone having a crown, a girdle and a pavilion, wherein the girdle is shaped such that, when viewed in plan view, it is primarily bounded by four pairs of parallel straight edges. Three of the four pairs of edges are spaced by roughly equal spacing $D_1$, while the remaining pair of edges is spaced by a spacing $D_2$, wherein $D_2$ is greater than $D_1$ by between 10% and 40%. Also provided is a method for cutting such a gemstone.

9 Claims, 6 Drawing Sheets

GEMSTONE AND CORRESPONDING METHOD OF CUTTING

This application benefits from the priority of Provisional Patent Application No. 60/481,079 filed Jul. 11, 2003.

FIELD AND BACKGROUND OF THE INVENTION

The present invention relates to ornamental gemstones and, in particular, it concerns a gemstone having an irregular octagonal girdle and corresponding methods of cutting gemstones.

Many different shapes or "cuts" are known for diamonds and other ornamental gemstones. For the purpose of the present invention, it is convenient to subdivide the known cuts into classes based upon the outline of the girdle as viewed in plan view. Thus, examples of the common gemstone cuts include those having girdles with the following shapes:

round—such as the "Round Brilliant" cut;

regular octagon;

square, such as the "Princess" cut; and cut-corner rectangle, such as the "Emerald" or "Radiant" cuts.

One of the many features contributing to the value of a cut gemstone is its weight. A critical factor in the profitability of gemstone cutting is thus the yield, i.e., the percentage of weight from a starting block of gemstone material which remains in the final cut gemstone. In many cases, the starting block from which gemstones are cut is supplied in the form of a square-based pyramid. When cutting a gemstone with a square-symmetry cut, the size of the starting block is clearly chosen to have a base of dimensions corresponding to the desired square cut dimensions. Where a cut with rectangular symmetry is to be used, the starting block is typically chosen to have a square or rectangular base with at least one side of the base of length equal to the desired length of the cut gemstone.

A further feature contributing to the value of a gemstone is its apparent size. In the case of a square-symmetry cut stone, the perceived size is generally gauged by the length of the side of the square outline. In the case of a stone cut with rectangular symmetry, the perceived size is generally gauged by the rectangular outline of "length" times "breadth".

By way of example, U.S. Pat. No. 5,657,646 to Rosenberg discloses various gemstone cuts with irregular octagonal girdles exhibiting major and minor dimensions. In each case, the minimum size of a starting block from which the gem is cut is clearly a pyramid with a rectangular base having one pair of sides of length equal to the major dimension of the finished gemstone. The perceived size of the gemstone would also be a function of these two dimensions.

There is therefore a need for a gemstone cut and corresponding method for cutting a gemstone which would facilitate relatively high yield and would provide a gemstone with a major dimension greater than the side of a square-based pyramidal block from which it is cut.

SUMMARY OF THE INVENTION

The present invention is a cut gemstone and corresponding method for cutting a gemstone.

According to the teachings of the present invention there is provided, a gemstone comprising a crown, a girdle and a pavilion, wherein the girdle is shaped such that, when viewed in plan view, the girdle is essentially bounded by eight substantially straight edges, the eight edges including four pairs of substantially parallel edges, wherein three of the four pairs of edges are spaced by a substantially equal spacing $D_1$, and wherein the remaining pair of the four pairs of edges are spaced by a spacing $D_2$ wherein $D_2$ is greater than $D_1$ by between 10% and 40%.

According to a further feature of the present invention, the eight substantially straight edges form a shape having two perpendicular planes of symmetry.

According to a further feature of the present invention, the eight substantially straight edges form a substantially equiangular irregular octagon.

According to a further feature of the present invention, the edges are arranged such that the largest circle which can be inscribed within the irregular octagon would touch six of the eight substantially straight edges at a tangent, and the remaining two of the eight substantially straight edges would lie totally outside the circle.

According to a further feature of the present invention, $D_2$ is greater than $D_1$ by between 15% and 30%, and more preferably by between 20% and 25%.

According to a further feature of the present invention, the pavilion is formed with a plurality of facets shaped and angled such that the pavilion exhibits four primary ridges converging towards a culet, wherein projections of the primary ridges onto a plane of the girdle run substantially parallel and perpendicular to the two edges spaced by spacing $D_2$.

According to a further feature of the present invention, the crown is formed with a table bounded at least in part by eight table edges, each of the table edges being parallel to a corresponding one of the edges of the girdle.

According to a further feature of the present invention, all of the table edges are spaced from the corresponding edges of the girdle by substantially equal distances.

According to a further feature of the present invention, the crown is formed with a plurality of facets including a set of eight facets substantially adjacent to the girdle, each of the facets being delimited in part by a pair of parallel facet edges, the pair of parallel facet edges of each of the eight facets being parallel to a corresponding one of the eight edges of the girdle.

According to a further feature of the present invention, one of the parallel facet edges for each facet coincides with the corresponding edge of the girdle.

There is also provided according to the teachings of the present invention, a method for cutting a gemstone from a block of gemstone material, the block having an initial shape corresponding substantially to a pyramid having a square base, the method comprising: (a) processing the block to generate two pairs of girdle edges lying on a square of side $D_1$, where $D_1$ is substantially equal to the length of a side of the square base of the block; (b) removing material from a first pair of diagonally opposing corners of the block substantially adjacent to the base so as to generate a third pair of girdle edges separated by a distance substantially equal to $D_1$; (c) removing material from the second pair of diagonally opposing corners of the block substantially adjacent to the base so as to generate a pair of girdle edges separated by a distance $D_2$, wherein $D_2$ is greater than $D_1$ by between 10% and 40%; (d) shaping the base of the block to form a plurality of crown facets; and (e) shaping the pyramid to form a plurality of pavilion facets.

According to a further feature of the present invention, the steps of removing are performed such that the girdle edges together form a shape having two perpendicular planes of symmetry.

According to a further feature of the present invention, the steps of removing are performed such that the girdle edges together form a substantially equi-angular irregular octagon.

According to a further feature of the present invention, the steps of removing are performed such that $D_2$ is greater than $D_1$ by between 15% and 30%, and preferably by between 20% and 25%.

According to a further feature of the present invention, the plurality of crown facets define a table bounded at least in part by eight table edges, each of the table edges being parallel to a corresponding one of the edges of the girdle.

According to a further feature of the present invention, all of the table edges are spaced from the corresponding edges of the girdle by substantially equal distances.

According to a further feature of the present invention, the plurality of crown facets includes a set of eight facets substantially adjacent to the girdle, each of the eight facets being delimited in part by a pair of parallel facet edges, the pair of parallel facet edges of each of the eight facets being parallel to a corresponding one of the eight edges of the girdle.

According to a further feature of the present invention, one of the parallel facet edges for each facet coincides with the corresponding edge of the girdle.

BRIEF DESCRIPTION OF THE DRAWINGS

The invention is herein described, by way of example only, with reference to the accompanying drawings, wherein.

DESCRIPTION OF THE PREFERRED EMBODIMENTS

The present invention is a cut gemstone and corresponding method for cutting a gemstone.

The principles and operation of gemstones and gemstone cutting methods according to the present invention may be better understood with reference to the drawings and the accompanying description.

Figure 2:
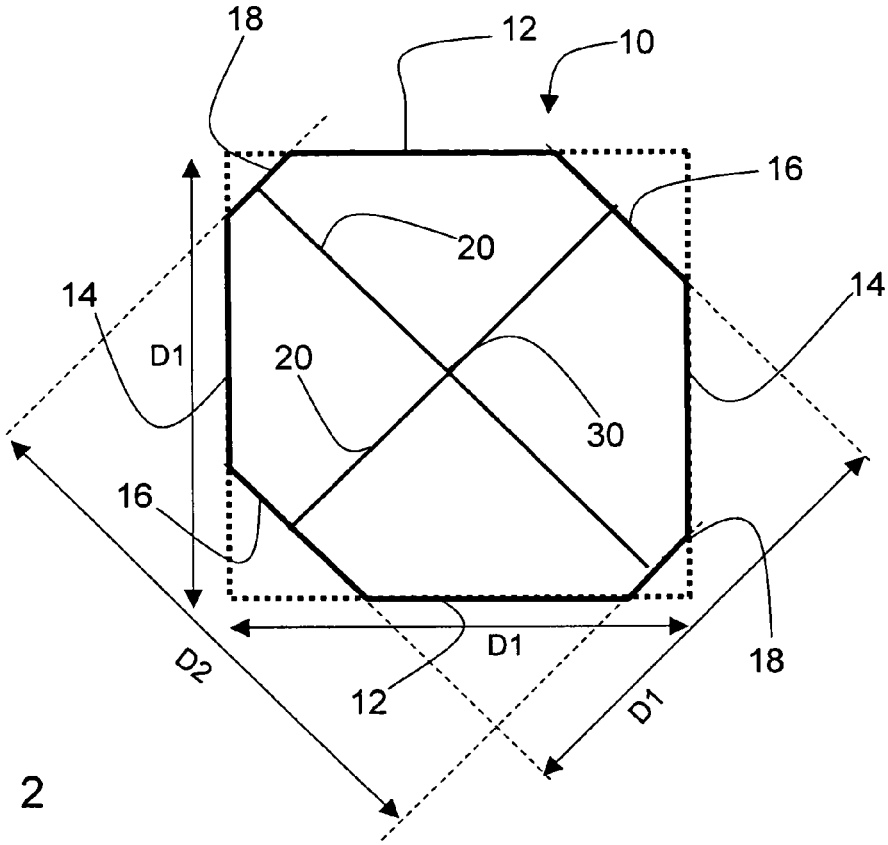
FIG. 2 is a schematic plan view of a gemstone cut from the pyramid of FIG. 1B to form an irregular octagonal girdle according to the teachings of the present invention.

Referring now to the drawings, FIG. 2 illustrates the primary defining features of a gemstone, generally designated 10, cut according to the teachings of the present invention. Specifically, the gemstone of the present invention is primarily defined in that it has a girdle shaped such that, when viewed in plan view, the girdle is essentially bounded by eight substantially straight edges, the eight edges including four pairs 12, 14, 16 and 18 of substantially parallel edges, wherein three of the four pairs of edges 12, 14 and 16 are spaced by a substantially equal spacing $D_1$, and wherein the remaining pair of edges 18 are spaced by a spacing $D_2$, wherein $D_2$ is greater than $D_1$ by between 10% and 40%.

Figure 1A:
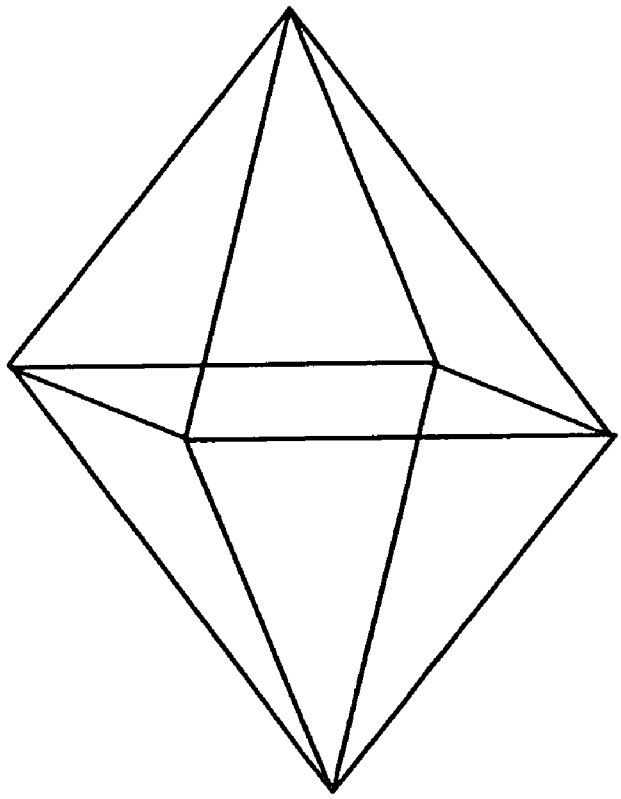
FIG. 1A is a schematic isometric representation of an uncut gemstone in the form of a square-based double-pyramid.
Figure 1B:
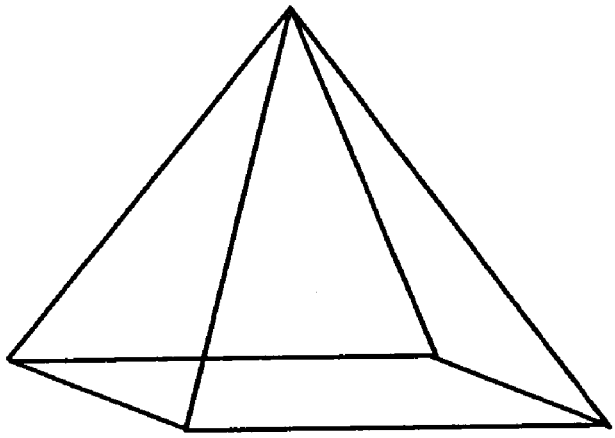
FIG. 1B is a view of a square-based pyramid formed by cleaving the double-pyramid of FIG. 1A into two parts.

In a preferred method for cutting the gemstone of FIG. 2, the gemstone is cut from a block of gemstone material having an initial shape corresponding substantially to the square base pyramid of FIG. 1B, and starts by processing the block to generate two pairs of girdle edges 12 and 14 lying on a square of side length $D_1$, substantially equal to (although practically slightly smaller than) the length of a side of the square base of the block. Material is then removed from a first pair of diagonally opposing corners of the block substantially adjacent to the base so as to generate a third pair of girdle edges 16 separated by a distance substantially equal to $D_1$, and from the remaining pair of diagonally opposing corners so as to generate a pair of girdle edges 18 separated by a distance $D_2$, wherein $D_2$ is greater than $D_1$ by between 10% and 40%.

It will be immediately apparent that the present invention thus defined provides various distinct advantages over the various prior art gemstone cuts. Firstly, the preferred implementation of the gemstone cut provides a relatively high yield, leaving significantly more of the material of the original block in the cut stone than would be present in an equilateral octagonal or round girdled stone cut from the same block. Specifically, since the volume of a generally pyramidal object of given height is proportional to the area of its base, the increased girdle size of the proposed cut leads to a correspondingly larger yield than the equilateral octagonal or round equivalents.

Figure 3:
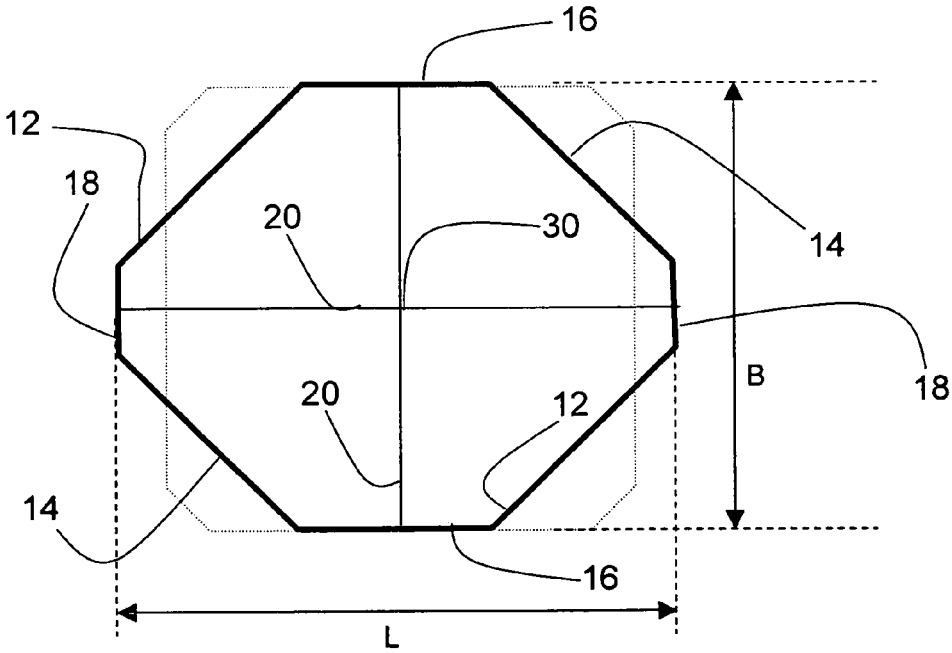
FIG. 3 is a schematic plan view of the gemstone of FIG. 2 rotated through 45° and shown superimposed on the outline of a "Square Radiant" gemstone cut from the same size initial pyramid.

Furthermore, referring to FIG. 3, it will be noted that the gemstone cut of the present invention surprisingly gives a visual impression of size greater than that of the block from which it was cut. Specifically, because of the asymmetrical removal of material from the corners of the square-base, the eye perceives the "length" L of the cut gemstone to be the distance between the girdle edges 18 corresponding to $D_2$, while the perceived "width" W corresponds to the distance between girdle edges 16 which is substantially equal to $D_1$. As a result, although the gemstone contains slightly less material than a "Square Radiant" cut from the same block, the visual impression generated is that of a larger stone. These and other advantages of the present invention will be better understood with reference to the following detailed description.

Before addressing the features of the present invention in more detail, it will be useful to define certain terminology as used herein in the description and claims. Firstly, it should be appreciated that the term "gemstone" or "stone" as used herein refers generically to any and all types of precious stones and semiprecious stones of unlimited dimensions. Most preferably, the invention relates to diamonds, although it may also be implemented to advantage with other precious and semiprecious stones. Furthermore, artificial or imitation gemstones also fall within the broad scope of the present invention.

The girdle of the cut gemstone of the present invention is described as "essentially bounded" by pairs 12, 14, 16 and 18 of substantially parallel edges. The words "essentially bounded" are used herein to convey that the recited edges substantially encompass the girdle of the stone. It should be noted that the resulting polygon may be modified somewhat, for example by rounding of the corners, without departing from the scope of the present invention.

When reference is made to a "spacing" or "distance" between parallel edges, this refers to a distance between the edges as measured perpendicular to the edges, or to the geometrical extension of the edges. Unless otherwise stated, where reference is made to geometrical relations between features of the crown or pavilion of the gemstone and edges of the girdle, the geometrical relations are defined using a perpendicular projection of the corresponding features of the crown or pavilion onto a plane passing through the girdle.

Where two or more spacings or distances are referred to herein as "substantially equal", the intention is that they appear roughly equal to the unaided human eye. In many cases, particularly where it does not disturb symmetry of the resulting shape, differentials of up to 10% may satisfy this condition and should be considered within the scope of this terminology. More preferably, the "substantially equal" distances of the present invention are within about 5% or each other, and typically within about 2%.

Where reference is made to "square symmetry" or "rectangular symmetry", these are used in their normal mathematical senses and refer primarily to the symmetry of the girdle edges only (although the girdle symmetry is preferably roughly maintained in the pavilion and crown structure). Thus, "square symmetry" refers to a shape which has four planes of symmetry at 45° angles and is invariant under rotations of 90°, while "rectangular symmetry" refers to a shape which has only two planes of symmetry at 90° to each other and is invariant under rotations of 180°.

With regard specifically to the method of the present invention, it will be noted that the various steps recited herein in the description and claims typically need not be performed in the specific order recited, as will be clear to one ordinarily skilled in the art.

Turning now to the features of the present invention in more detail, the differential between dimensions $D_2$ and $D_1$ as stated above lies in the range of 10% to 40%. In order to maximize the yield achieved by the present invention, differentials somewhat greater than 10% are preferred. On the other hand, in order to avoid an overly "pointed" appearance, it is preferable to stay somewhat below the upper limit of 40%. Accordingly, $D_2$ is greater than $D_1$ by between 15% and 30%, and most preferably, by between 20% and 25%. For certain implementations, a proportion of 22%±1% is considered ideal.

In particularly preferred implementations of the present invention, the eight edges of the girdle satisfy one or more of a number of additional geometrical conditions. Specifically, preferred properties of the girdle geometry include the following conditions:

The eight substantially straight girdle edges preferably form a shape having rectangular symmetry, corresponding to exactly two perpendicular planes of symmetry.

The eight substantially straight girdle edges preferably form a substantially equi-angular irregular octagon.

The girdle edges are preferably arranged such that the largest circle which can be inscribed within the irregular octagon would touch six edges 12, 14, 16 at a tangent, and the remaining two edges 18 would lie totally outside the circle. (It should be noted that the aforementioned circle is a geometrical construct only, and does not correspond to any structural feature of the gemstone itself.)

Turning now to the remaining features of the present invention, it should be noted that the girdle shape described thus far and the methods for cutting a gemstone are applicable to gemstones with any desired form of crown and pavilion. Nevertheless, by way of a non-limiting preferred example, a particularly preferred implementation of the pavilion and crown according to the present invention will now be described with reference to FIGS. 4-6. The gemstone working techniques necessary to generate the forms described are well known to those ordinarily skilled in the art, and will not be discussed here.

Referring first back to FIGS. 2 and 3, it will be noted that the preferred method of cutting the gemstone according to the present invention results in the corner ridges 20 of the original pyramid of gemstone material extending substantially parallel and perpendicular to edges 18 as viewed in plan view (i.e., corresponding to a projection onto plane of girdle). Although these edges themselves are typically removed during the shaping of the pavilion, most efficient use of the gemstone material is typically achieved by maintaining an overall form with four primary ridges converging towards the culet 30 where the ridges run substantially parallel and perpendicular to edges 18.

Figure 4:
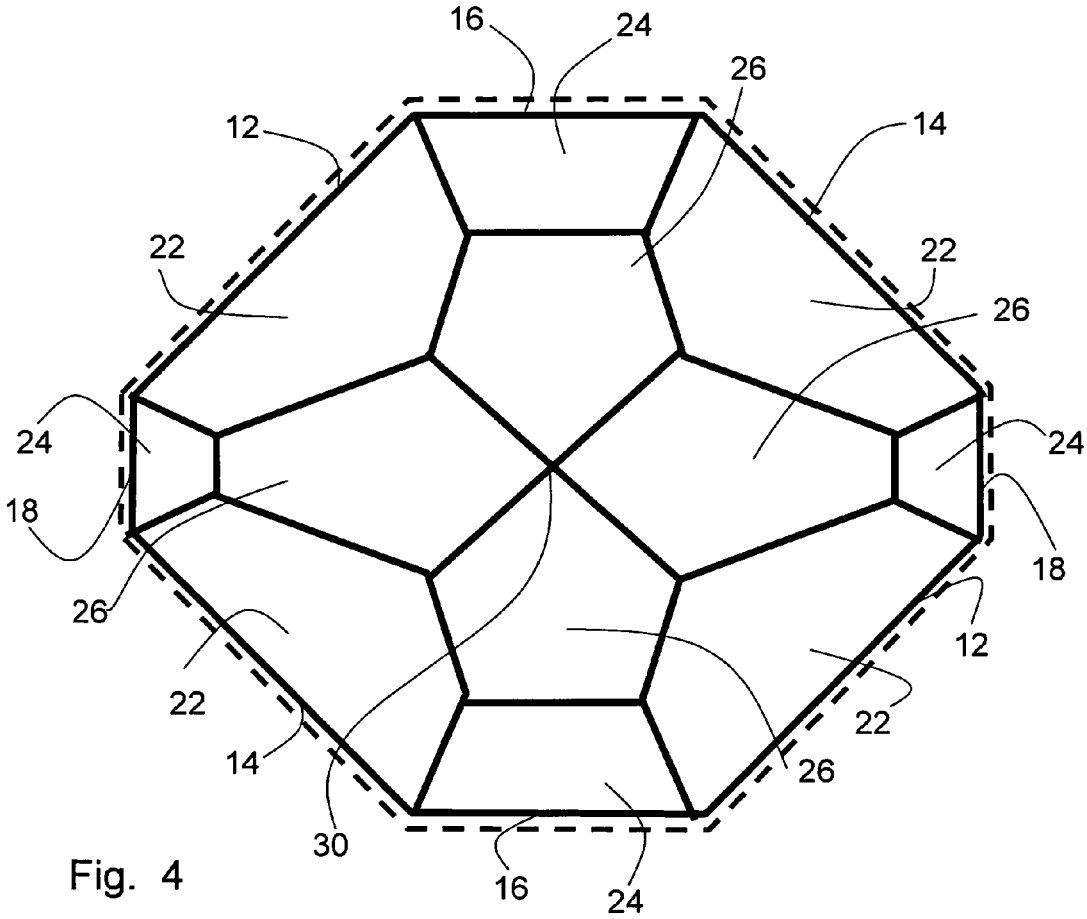
FIG. 4 is a schematic plan view of the primary cuts of an exemplary implementation of a pavilion for the gemstone of FIG. 2.
Figure 5:
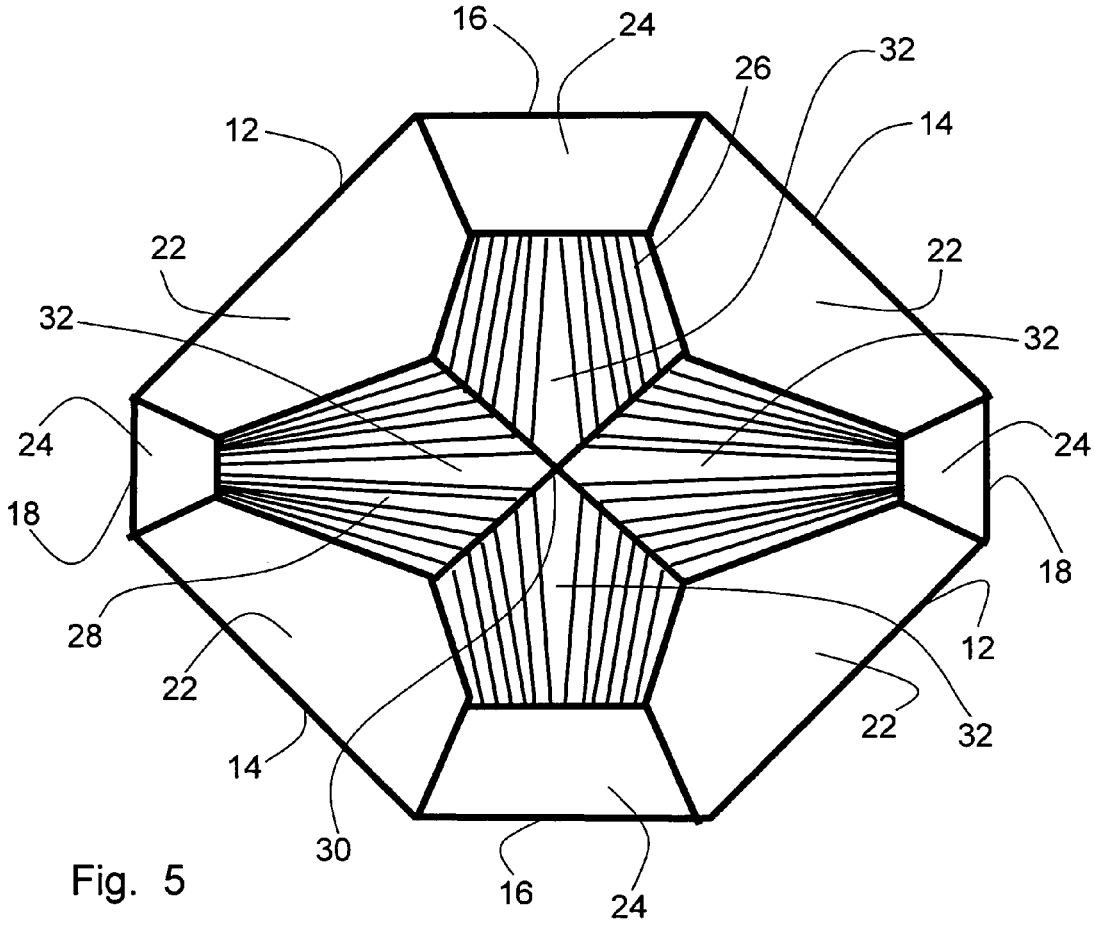
FIG. 5 is a schematic plan view similar to FIG. 4 after formation of multiple ridge facets to "brilliantize" the gemstone.

Turning now to FIG. 4, this shows a preferred arrangement of major facets 22, 24 and 26 for the pavilion of a gemstone according to the present invention, where facets 22 are typically part of the original square pyramid and facets 24 and 26 have been formed by cutting away corner ridges 20. FIG. 5 shows the same gemstone after formation of multiple ridge facets 28 in the region of facets 26 to "brilliantize" the gemstone. As will be seen, the aforementioned general directions of the ridges 32 parallel and perpendicular to edges 18 are preserved.

Figure 6:
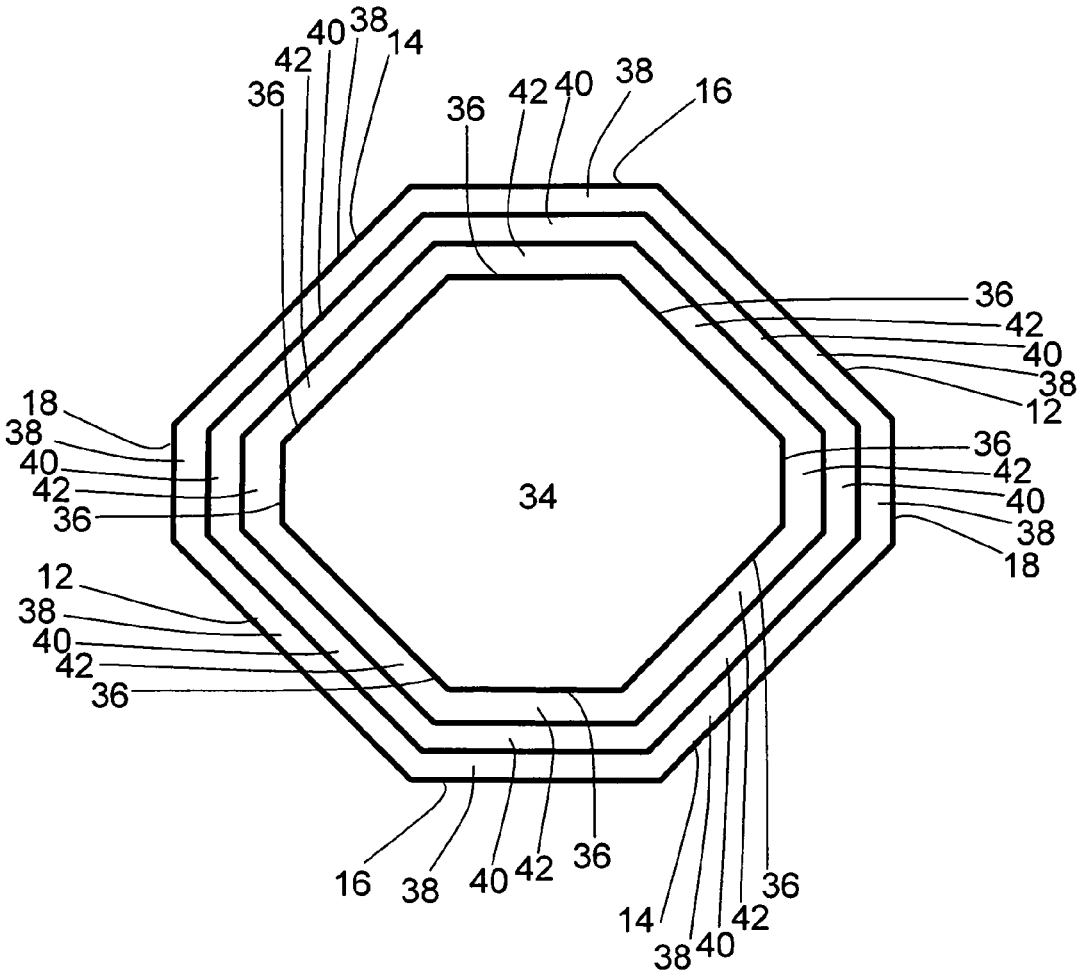
FIG. 6 is a schematic plan view of an exemplary implementation of the crown of the gemstone of FIG. 2.

Turning now to FIG. 6, a particularly preferred form for the crown of the gemstone features a table 34 bounded at least in part by eight table edges 36, each parallel to a corresponding one of the edges of the girdle 12, 14, 16, 18. Most preferably, table edges 36 are spaced from the corresponding edges of the girdle by substantially equal distances. In the preferred example shown here, the crown is also formed with a plurality of facets including at least one, and in this case three, sets of eight parallel-edged facets 38, 40, 42 substantially adjacent to the girdle and extending parallel to a corresponding one of the girdle edges. In the case of facets 38, one of the girdle edges itself coincides with an edge of the facet. This provides an overall crown appearance similar to that associated with the "emerald" cut.

Figure 7:
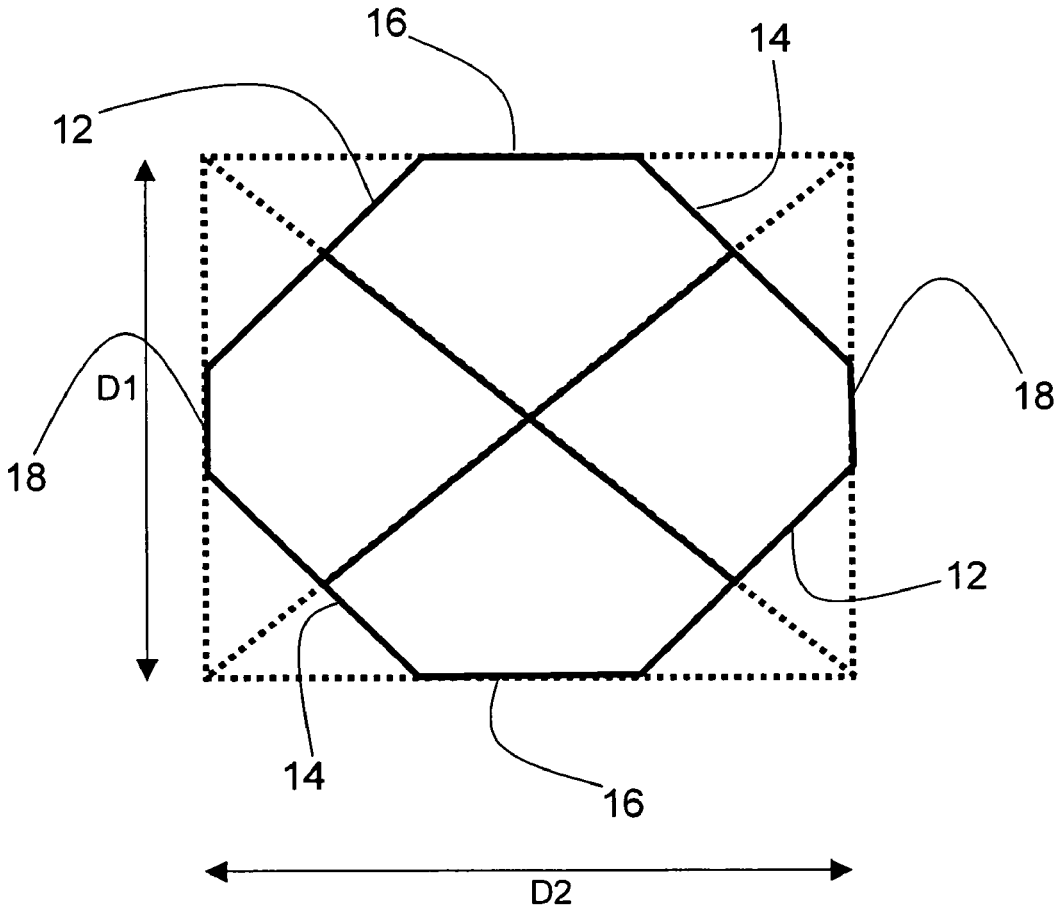
FIG. 7 is a schematic plan view of an alternative implementation of a gemstone cut from a rectangular pyramid to form an irregular octagonal girdle according to the teachings of the present invention.

Finally, referring briefly to FIG. 7, it should be noted that the gemstone cut of the present invention is not limited by the preferred method of cutting described hereinabove. By way of a non-limiting additional example, FIG. 7 shows schematically an implementation of the gemstone of the present invention cut from a rectangular-base pyramid of gemstone material of initial base dimensions $D_2 \times D_1$. It will be noted that the resulting stone will generally exhibit angles of primary ridges in the pavilion which are not parallel or perpendicular to edges 18, thus differing from the preferred angles of the primary ridges in the first implementation described above. Furthermore, the ridges of this second implementation are typically not mutually orthogonal in plan view, as is clearly visible in the illustration.

It will be appreciated that the above descriptions are intended only to serve as examples, and that many other embodiments are possible within the scope of the present invention as defined in the appended claims.

What is claimed is:

1. A method for cutting a gemstone from a block of gemstone material, the block having an initial shape corresponding substantially to a pyramid having a square base, the method comprising:

(a) processing the block to generate two pairs of girdle edges lying on a square of side $D_1$, where $D_1$ is substantially equal to the length of a side of the square base of the block;

(b) removing material from a first pair of diagonally opposing corners of the block substantially adjacent to the base so as to generate a third pair of girdle edges separated by a distance substantially equal to $D_1$;

(c) removing material from the second pair of diagonally opposing corners of the block substantially adjacent to the base so as to generate a pair of girdle edges separated by a distance $D_2$, wherein $D_2$ is greater than $D_1$ by between 10% and 40%;

(d) shaping the base of the block to form a plurality of crown facets; and (e) shaping the pyramid to form a plurality of pavilion facets, thereby forming an ornamental gemstone having a girdle substantially bounded by said pairs of girdle edges.

2. The method of claim 1, wherein said steps of removing are performed such that said girdle edges together form a shape having two perpendicular planes of symmetry.

3. The method of claim 1, wherein said steps of removing are performed such that said girdle edges together form a substantially equi-angular irregular octagon.

4. The method of claim 1, wherein said steps of removing are performed such that $D_2$ is greater than $D_1$ by between 15% and 30%.

5. The method of claim 1, wherein said steps of removing are performed such that $D_2$ is greater than $D_1$ by between 20% and 25%.

6. The method of claim 1, wherein said plurality of crown facets define a table bounded at least in part by eight table edges, each of said table edges being parallel to a corresponding one of said edges of said girdle.

7. The method of claim 6, wherein all of said table edges are spaced from the corresponding edges of said girdle by substantially equal distances.

8. The method of claim 1, wherein said plurality of crown facets includes a set of eight facets substantially adjacent to said girdle, each of said eight facets being delimited in part by a pair of parallel facet edges, said pair of parallel facet edges of each of said eight facets being parallel to a corresponding one of said eight edges of said girdle.

9. The method of claim 8, wherein one of said parallel facet edges for each facet coincides with the corresponding edge of said girdle.

* * * * *